US006257161B1

(12) United States Patent
Lindeman et al.

(10) Patent No.: US 6,257,161 B1
(45) Date of Patent: Jul. 10, 2001

(54) FAIRINGS FOR CABLES

(75) Inventors: Gunnar Andreas Lindeman, Haslum; Ottar Kristiansen; Arne Ramstad, both of Nyborg, all of (NO)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/581,825

(22) PCT Filed: Dec. 7, 1998

(86) PCT No.: PCT/IB98/01945

§ 371 Date: Jun. 16, 2000

§ 102(e) Date: Jun. 16, 2000

(87) PCT Pub. No.: WO99/34237

PCT Pub. Date: Jul. 8, 1999

(30) Foreign Application Priority Data

Dec. 23, 1997 (GB) ..... 9727219

(51) Int. Cl.[7] ..... F15D 1/10

(52) U.S. Cl. ..... 114/243

(58) Field of Search ..... 114/67 R, 243

(56) References Cited

U.S. PATENT DOCUMENTS 2,397,957 * 4/1946 Freeman ..... 114/243
4,171,874 * 10/1979 Hale ..... 114/243

* cited by examiner

*Primary Examiner*—Ed Swinehart
(74) *Attorney, Agent, or Firm*—John H. Bouchard

(57) ABSTRACT

A fairing for reducing the drag produced by a lead-in cable which is being used to tow one or more seismic streamers forming part of a wide streamer array comprises a plurality of fairing sections, each having a central bore to receive the lead-in and a streamlined profile. The sections are coupled together end-to-end by swivel couplings which permit rotation of the sections relative to each other, so that each section can adopt the optimum orientation for drag reduction. Drag reduction is further enhanced by providing the upper and lower surfaces of the leading edge of each fairing section with respective sets of longitudinally extending ridges/grooves.

12 Claims, 3 Drawing Sheets

FAIRINGS FOR CABLES

BACKGROUND OF THE INVENTION

The present invention relates to fairings for cables, and is more particularly but not exclusively concerned with fairings for lead-in cables used for towing arrays of seismic streamers during the performance of marine seismic surveys.

In order to perform a marine seismic survey, an array of seismic streamers, each typically several thousand metres tong, is towed at a speed of about 5 knots behind a seismic survey vessel. The streamers contain arrays of hydrophones and associated electronic equipment, distributed along their length. The survey vessel also tows one or more seismic sources, for example, air guns. Acoustic signals produced by the seismic sources are directed down through the water into the earth beneath, where they are reflected by the various strata. The reflected signals are received by the hydrophones, digitised and transmitted to the seismic survey vessel, where they are recorded and at least partially processed, with the aim of building up a representation of the earth strata in the area being surveyed.

In such streamer arrays, each streamer may be towed by means of its own lead-in cable, that is, an armoured electrical cable which supplies power to and receives digital signals from the streamer. Using this method, it is, typically, possible to tow a 700 metre wide array of eight streamers, each 4000 metres long.

The drag produced by such an array at a towing speed of five knots is about 40–45 tonnes, a high proportion of which is cross-line drag due to the transversely extending lead-in cables rather than in-line drag due to the streamers themselves. This drag is a very significant factor in the operating costs associated with such surveys, contributing primarily to fuel costs associated with the towing vessel.

To increase the efficiency of marine surveys of this kind, it would be desirable to use even wider streamer arrays containing a larger number of streamers. However, using current towing techniques, an array 1440 metres wide including ten streamers, for example, would produce a drag of over 70 tonnes, which makes the use of such wider arrays containing more streamers unattractive.

SUMMARY OF THE INVENTION

It is an object of the present invention to alleviate this problem.

In accordance with one aspect of the invention there is provided a fairing for use on a cable, in particular a lead-in cable for a seismic streamer array, the fairing comprising. a plurality of fairing sections having a central opening in which the cable is received and a streamlined profile which acts to reduce drag when the cable is moved through water in a direction transverse to its length; and at least one coupling assembly for fastening together adjacent fairing sections in such a manner as to permit rotation of said adjacent fairing sections relative to one another.

In a preferred embodiment of the invention, the coupling assembly comprises a pair of end connectors each of which is secured to an end of one of a pair of adjacent fairing sections and has a radially outwardly projecting flange formed thereon, and an annular clamping ring which is made of a low friction material, and which secures together the flanges formed on the end connectors while permitting them to rotate relative to one another.

Advantageously, the annular clamping ring is made in two semi-circular parts which are secured together, and is of U-shaped cross-section so as to trap within the U-section the flanges of the end connectors.

In a further aspect, the invention provides a fairing for use on a cable, in particular a lead-in cable for a seismic streamer array, the fairing having a central opening in which the cable is received and a streamlined profile which acts to reduce drag when the cable is moved through water in a direction transverse to its length, wherein the fairing is provided with a plurality of longitudinally extending ridges formed on a part of the fairing which will, in use, be at or adjacent the leading edge thereof the

BRIEF DESCRIPTION OF THE DRAWINGS

The invention will now be described in detail, by way of example, with reference to the accompanying drawings, in which.

DESCRIPTION OF THE PREFERRED EMBODIMENT

The assembled fairing of the invention comprises a plurality of elongate generally tubular fairing sections 10, which are coupled together by means of suitable couplings 25 at their adjacent ends to form a continuous fairing around the lead-in cable.

Figure 1:
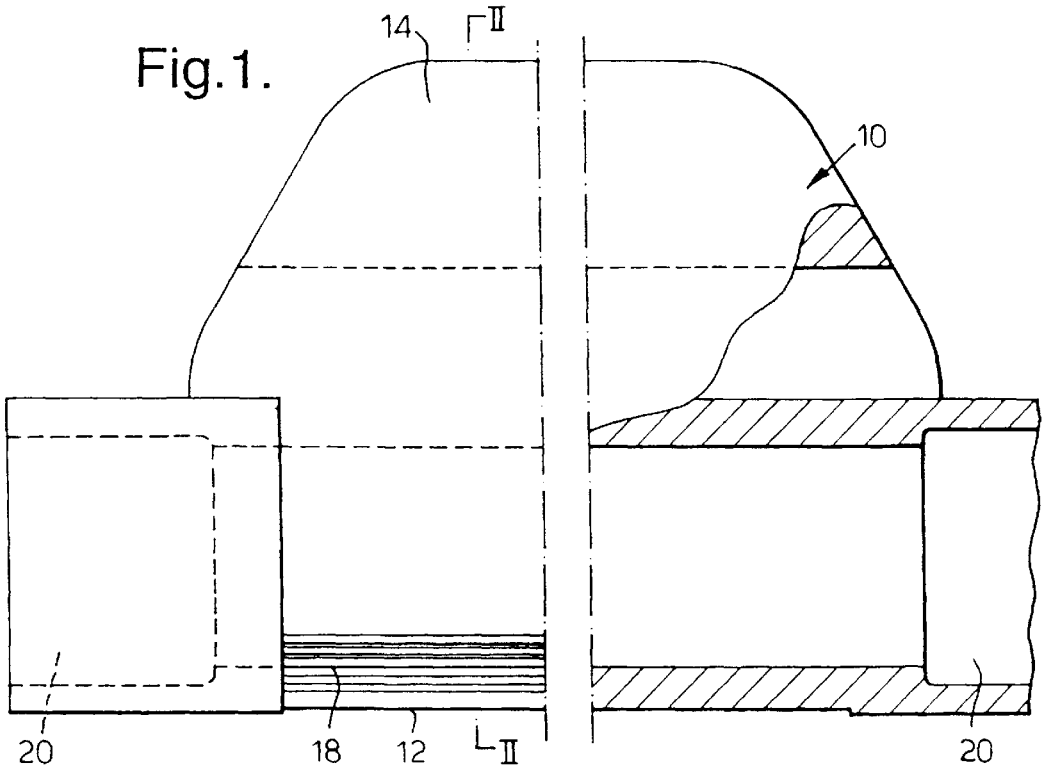
FIG. 1 is a part-elevational, part sectional view of a fairing section in accordance with one embodiment of the invention.
Figure 2:
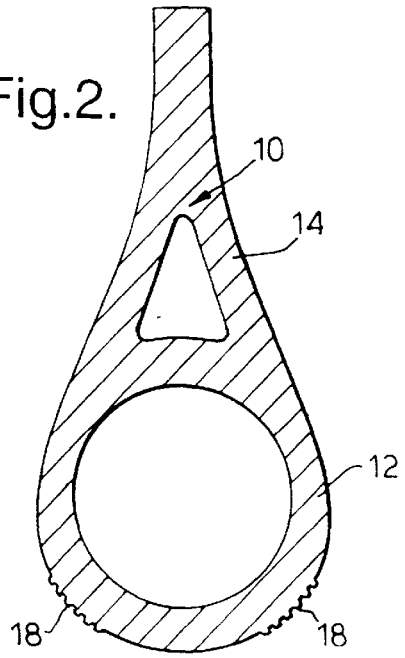
FIG. 2 is a section taken on line II—II of FIG. 1

A preferred form of fairing section 10 is shown in FIGS. 1 and 2. Each fairing section 10 comprises a generally cylindrical body portion 12 which is extended at one side, to form a generally triangular-section tail portion 14. The cylindrical body portion 12 forms a sleeve around the lead-in cable (not shown). The triangular-section tail portion 14, which is generally hollow, extends in a radial direction from the cable, forming a trailing edge as the cable is dragged through the water. The tail portion 14 is made hollow to improve the weight balance of the profile of the fairing section 10 with respect to its pivoting centre (ie the axis of the lead-in cable) and to reduce storage volume. As can be seen in FIG. 2, the overall profile of each fairing section 10 is 'teardrop' shaped, providing much less drag than a plain cylindrical cable.

A further drag reducing feature is formed on the cylindrical body portion 12 adjacent what is, in use, the leading edge of the fairing. Symmetrically disposed about the central radial axis of the tail portion 14 are two sets of longitudinally extending parallel ridges or ribs 18. The purpose of these ridges 18 is to 'roughen' the leading edge surface of the fairing section 10 and so trigger the creation of a thin turbulent boundary layer to control the laminar flow separation over the profile of the fairing section in accordance with known hydrodynamic principles. Substantially the same "roughening" effect is produced by grooves rather than ridges, and the term "ridges" as used herein is to be understood as encompassing both ridges and grooves.

At each of its ends, each fairing section 10 is provided with a cylindrical socket 20 of larger diameter than the cylindrical opening through the main part of the body portion 12 of the fairing section 10.

The fairing sections can conveniently be formed of extruded EPDM rubber with reinforcing fibres made of Kevlar (registered trade mark) in the cylindrical wall of the body portion 12. The fairing sections 10 may be in the range 3 m to 10 m in length and are of a size to give a clearance of 2 mm around the lead-in cable. This clearance is sufficient to allow the fairing to swivel freely about the cable but is a sufficiently close fit to avoid excessive movement of the lead-in cable within the fairing, which might cause damage.

It is desirable that the fairing section can swivel about the cable so that they can take up the most favourable position for reducing drag relative to the direction of movement of the lead-in cable through the water, without the cable itself having to twist in the water to accommodate this streamlining. For this reason, it is also desirable that neighbouring fairing sections 10 are able to swivel freely relative to one another. To permit this, adjacent fairing sections 10 are joined by means of the swivel coupling 25 illustrated in FIGS. 3 to 6 of the drawings.

Figure 3:
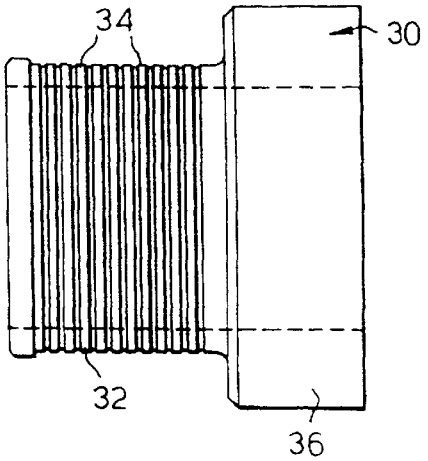
FIG. 3 is a side elevational view of an end connector for use in joining together the fairing sections of FIG. 1.
Figure 4:
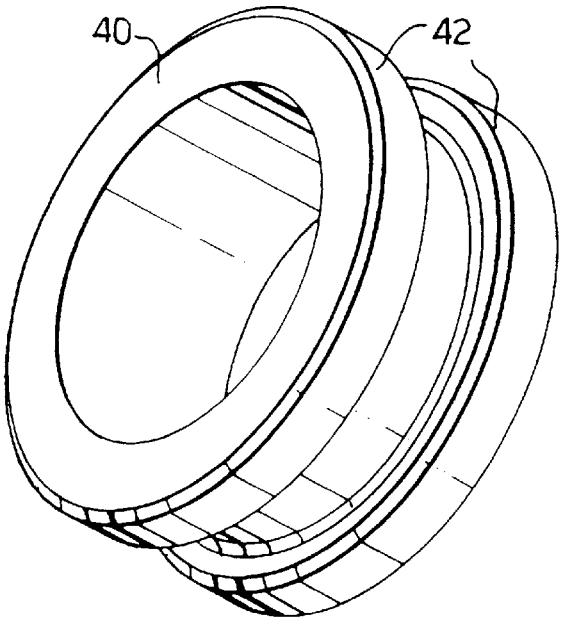
FIG. 4 is a perspective view of a swivel bearing which forms part of a coupling for joining the fairing sections of FIG. 1.
Figure 5:
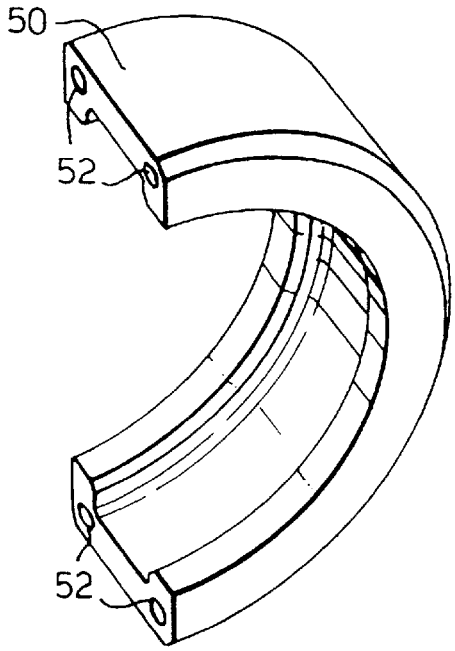
FIG. 5 is a perspective view of a clamping ring which forms part of a coupling for joining the fairing sections of FIG. 1.
Figure 6:
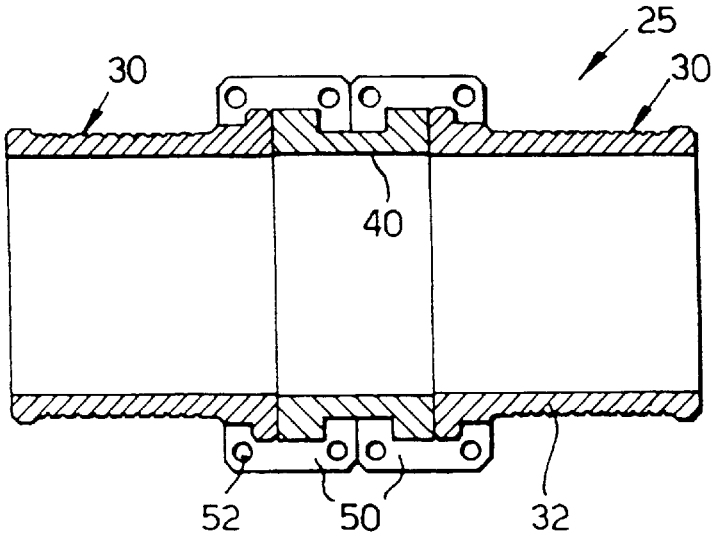
FIG. 6 is a section taken through an assembled coupling including the end connector of FIG. 3, the swivel bearing of FIG. 4 and the clamping ring of FIG. 5.

The coupling 25 shown in the drawings has four components, an end connector 30 shown in FIG. 3, a swivel bearing 40 shown in FIG. 4, and two clamping rings 50, one of which is shown in FIG. 5.

The end connector 30 is made of, for example, stainless steel and consists of a spigot 32 provided with a plurality of circumferentially extending grooves 34. At one end, the end connector 30 is provided with an outwardly extending annular flange 36. The spigot 32 is inserted into the cylindrical socket 20 formed at the end of the fairing section 10 and secured to it by crimping, using a suitable crimp ring of soft metal (not shown). The grooves 34 on the spigot 32 help to ensure that the crimping operation fastens the end connector 30 to the fairing section 10 securely. Each fairing section 10 is provided with an end connector 30 at both of its ends, if it is to be adjacent two other such sections. Alternative couplings arrangements may be appropriate at the ends of the lead-in cables, where the fairing sections 10 may be connected to other equipment, as will be described in more detail hereinafter, or may simply be left free.

Between each pair of end connectors 30 at the adjacent ends of neighbouring fairing sections 10 is positioned a swivel bearing 40. The swivel bearing 40 is a ring, typically made of aluminium bronze and of generally U-shaped cross-section, with two parallel annular flanges 42. in use, as can be seen most clearly in FIG. 6, the swivel bearing is located between the end connectors 30 of two adjacent fairing sections 10. The annular end surfaces of the two parallel flanges 42 of the swivel bearing 40 abut the annular flanges 36 on the two end connectors 30, providing a bearing surface against which the end connectors 30 can rotate.

It will be appreciated that, in assembling the complete fairing, after each fairing section 10 is threaded on to the lead-n cable, two end connectors 30, properly oriented relative to one another and to the fairing sections 10, must be threaded on to the lead-in cable, separated by a swivel bearing 40.

The coupling 25 between each pair of adjacent fairing sections is completed by means of clamping rings 50 shown in FIG. 5.

Each clamping ring 50 is formed in two semi-circular parts which together form a ring having two inwardly directed flanges, thus giving the clamping ring a U-shaped cross section. Each coupling includes two clamping rings 50, each of which clamps together the annular flange 36 on one of the end connectors 30 and one of the two outwardly directed flanges 42 on the swivel bearing 40. The two halves of each clamping ring 50 can be secured together in a conventional fashion by means of suitable screws or bolts (not shown) which pass through holes 52 formed in the two halves of each clamping ring.

The completed clamping ring 50 traps the flange 36 on the end connector 30 and the flange 42 on the swivel bearing 40 in its U-shaped cross section, but in such a way that the two can rotate freely relative to one another.

As indicated earlier, the groups of adjacent fairing sections 10 are mechanically secured to the lead-in cable at, and only at, the two free ends of the groups of fairing sections. This is desirable to prevent stacking or telescoping of groups of adjacent sections 10.

Figure 7:
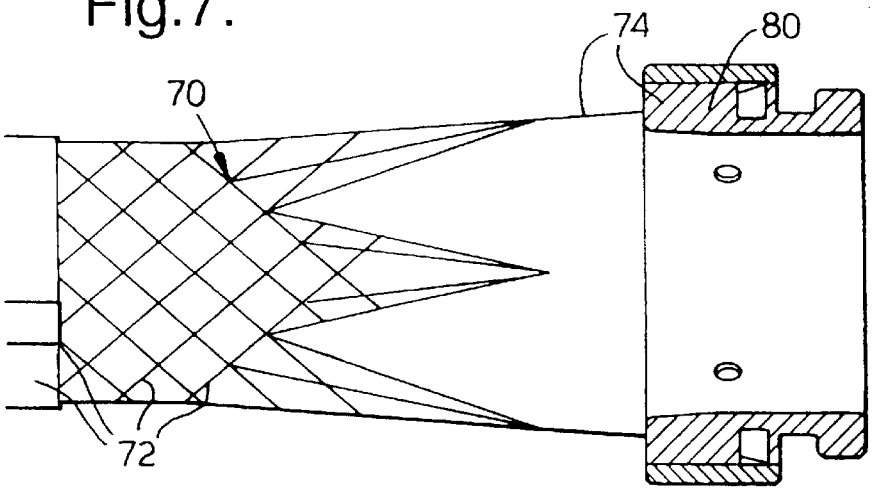
FIG. 7 is a part-sectional view of an anchoring assembly for securing a group of adjacent fairing sections to a lead-in cable, axially.
Figure 8:
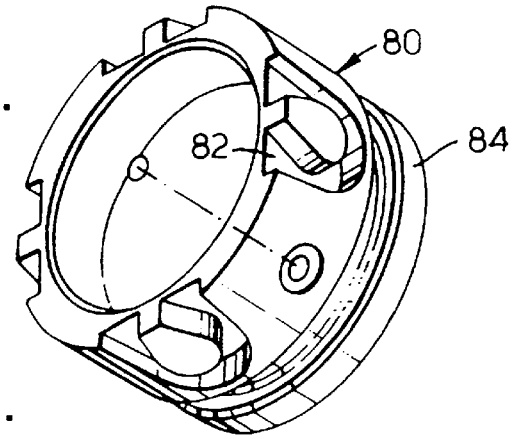
FIG. 8 is a perspective view of an anchoring ring forming part of the anchoring assembly of FIG. 7.

Securing of the fairing sections to the lead-in cable is achieved using the arrangement shown in FIGS. 7 and 8. As shown in FIG. 7, the lead-in cable has an armoured sheath 70 which is provided with reinforcing fibres 72. Loops 74 are formed in the reinforcing fibres 72. These loops 74, in use, lie and are held in four horseshoe-shaped grooves 82 formed in an anchoring bracket 80, shown in FIG. 8. The anchoring bracket is provided at its end remote from the horseshoe-shaped grooves 82 with an outwardly extending flange 84 similar in configuration to the annular flanges 36 formed on the end connectors 30.

The flange 84 on the anchoring ring 80 is secured to the annular flange 36 of the end connector on the end-most fairing section 10 in exactly the same manner as the annular flanges 36 of adjacent end connectors 30 are secured to one another.

The inter-engagement of the loops 74 formed on the armoured sheath 70 of the lead-in cable with the end-most fairing sections 10 through the anchoring ring 80 and adjacent end connector 30 serves to maintain the group of adjacent fairing sections 10 in a more or-less fixed axial position relative to the lead-in cable.

Figure 9:
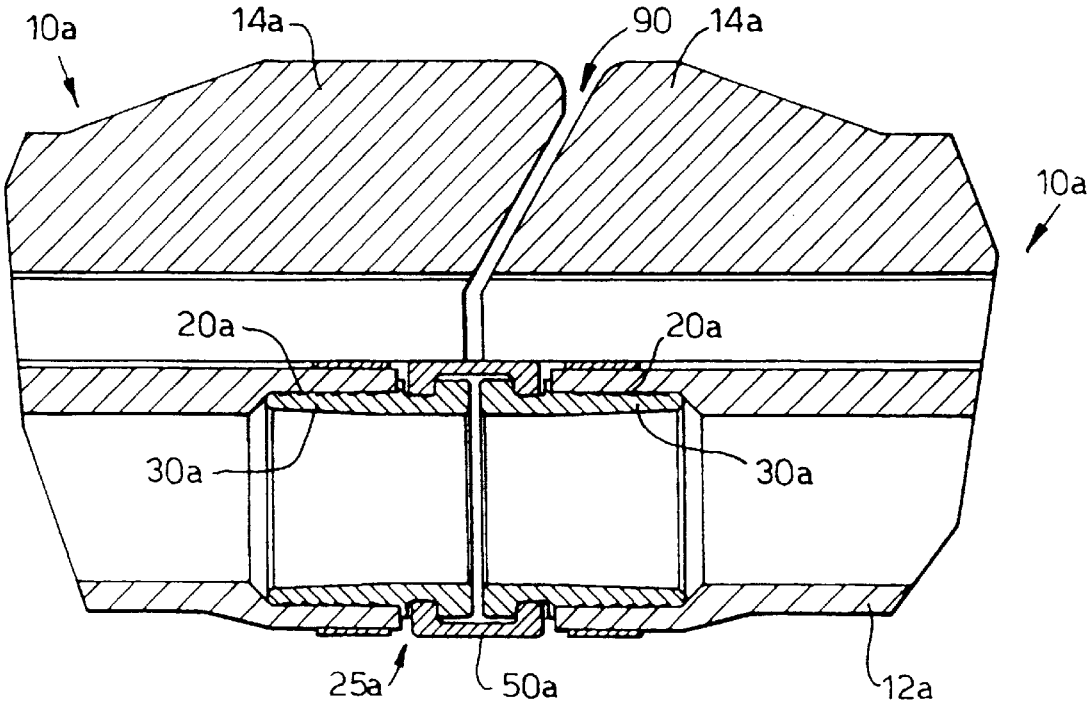
FIG. 9 is a section taken through an alternative form of the coupling of FIGS. 3 to 6, shown connecting two adjacent fairing sections in accordance with another embodiment of the invention.

FIG. 9 shows a modified version of the fairing of FIGS. 1 to 6, in which corresponding elements are given the same references as were used in FIGS. 1 to 6, but with the suffix a. Thus the modified fairing of FIG. 9 is made up of fairing sections 10*a* basically similar to the fairing sections 10, except that at their respective enlarged coupled-together ends, ie the enlarged regions of the cylindrical body portions 12*a* containing the sockets 20*a*, the tail portion 14*a* is also enlarged, to maintain the ratio between the diameter of the cylindrical body portion 12*a* to the length of the fairing from its leading to its trailing edge substantially constant. Additionally, the width of the gap 90 between adjacent fairing sections is much reduced, and inclined so that, in use, its length is more closely aligned with direction of movement of the fairing through the water.

The coupling 25*a* is much simplified, in that the swivel bearing 40 is omitted, and a single two-piece clamping ring

50*a* fits over and entraps the flanges 36*a* of adjacent end connectors 30*a*. The clamping ring 50*a* effectively performs the bearing function that was performed by the swivel bearing 40, and to this end is made from a hard low friction plastics material, preferably polyoxymethylene (POM).

The fairings described above significantly reduce drag arising from the laterally extending lead-in cables used in the towing of seismic streamer arrays, thus reducing operational costs, particularly fuel costs, and/or allowing economic use of larger arrays.

What is claimed is:

1. A fairing adapted for use in connection with a cable, said fairing comprising:

a plurality of fairing sections, each fairing section having a central opening and a streamlined profile, said central opening adapted to receive said cable, said streamlined profile acting to reduce drag when the cable is moved through water in a direction transverse to a length of said cable; and at least one coupling assembly adapted for fastening together adjacent fairing sections, the adjacent fairing sections adapted to rotate relative to one another when the coupling assembly fastens together said adjacent fairing sections, the coupling assembly including, a pair of end connectors, each of the end connectors being secured to an end of one of a pair of adjacent fairing sections, each of the end connectors having a radially outwardly projecting flange formed thereon, and an annular clamping ring, comprised of a low friction material, adapted for securing together the flanges formed on the end connectors while permitting said flanges to rotate relative to one another.

2. The fairing of claim 1, wherein said end connectors are each secured to the fairing sections by crimping.

3. The fairing of claim 1, wherein said annular clamping ring comprises two semi-circular circular parts which are secured together, said annular clamping ring having a U-shaped cross-section adapted for trapping the flanges of the end connectors within said U-shaped cross-section.

4. The fairing of claim 3, wherein said clamping ring is comprised of a plastics bearing material.

5. The fairing of claim 4, wherein said plastics bearing material comprises polyoxymethylene (POM).

6. The fairing of claim 1, wherein at least one fairing section includes a plurality of longitudinally extending ridges formed on a particular part of the fairing section, said particular part being at or adjacent a leading edge of the fairing section when said fairing section is in use.

7. The fairing of claim 6, wherein said fairing section comprises two groups of longitudinally extending ridges arranged generally symmetrically around said leading edge of the fairing section when said fairing section is in use.

8. A fairing adapted for use in connection with a cable, said fairing comprising:

a plurality of fairing sections including, a central opening adapted to receive the cable, and a streamlined profile adapted to reduce drag when said cable is moved through water in a direction transverse to a length of said cable, at least one of said plurality of fairing sections including a plurality of longitudinally extending ridges formed on a particular part of the fairing section, said particular part being at or adjacent a leading edge of the fairing section when the fairing section is in use, at least one end of the fairing sections being secured to a lead-in cable by means of an anchoring assembly which engages a sheath of the lead-in cable, axial movement of the fairing sections relative to the lead-in cable being substantially prevented when said at least one end of the fairing sections is secured to the lead-in cable.

9. The fairing of claim 8, wherein said anchoring assembly comprises an anchoring ring which includes at least one horseshoe-shaped groove adapted for receiving a fiber incorporated in said sheath.

10. The fairing of claim 8, wherein said at least one of said plurality of fairing sections comprise two groups of the longitudinally extending ridges arranged generally symmetrically around said leading edge of said at least one fairing section.

11. A fairing adapted for use in connection with a cable, said cable including a lead-in cable for a seismic streamer array, said fairing comprising:

a plurality of fairing sections, each fairing section having a central opening and a streamlined profile, said central opening adapted to receive said cable, said streamlined profile acting to reduce drag when the cable is moved through water in a direction transverse to a length of said cable; and at least one coupling assembly adapted for fastening together adjacent fairing sections, the adjacent fairing sections adapted to rotate relative to one another when the coupling assembly fastens together said adjacent fairing sections, at least one end of the fairing sections being secured to the lead-in cable by means of an anchoring assembly which engages a sheath of the lead-in cable, axial movement of the fairing sections relative to the lead-in cable being substantially prevented when said at least one end of the fairing sections is secured to the lead-in cable.

12. The fairing of claim 11, wherein the anchoring assembly comprises an anchoring ring formed with at least one horseshoe-shaped groove for receiving a fiber incorporated said sheath.

* * * * *